US005145316A

United States Patent [19]

Birch

[11] Patent Number: 5,145,316

[45] Date of Patent: Sep. 8, 1992

[54] GAS TURBINE ENGINE BLADE SHROUD ASSEMBLY

[75] Inventor: Kenneth W. Birch, Derby, England

[73] Assignee: Rolls-Royce plc, London, England

[21] Appl. No.: 608,708

[22] Filed: Nov. 5, 1990

[30] Foreign Application Priority Data

Dec. 8, 1989 [GB] United Kingdom ..... 8927865

[51] Int. Cl.[5] ..... F01D 5/20

[52] U.S. Cl. ..... 415/173.1; 415/173.3

[58] Field of Search ..... 415/209.1, 209.2, 209.3, 415/189, 190, 173.1, 173.3, 174.2, 173.7, 134, 138

[56] References Cited

U.S. PATENT DOCUMENTS

| | | | |
|---|---|---|---|
| 2,858,104 | 10/1958 | Kelk et al. | 415/190 |
| 2,863,634 | 12/1958 | Chamberlin et al. | 415/134 |
| 2,910,269 | 10/1959 | Howorth et al. | 415/209.1 |
| 2,928,586 | 3/1960 | Hart | 415/209.1 |
| 3,024,968 | 3/1962 | Payne et al. | 415/209.3 |
| 3,841,787 | 10/1974 | Scalzo | 415/138 |
| 3,869,222 | 3/1975 | Rahnke et al. | 415/173.1 |
| 3,892,497 | 7/1975 | Gunderlock et al. | 415/134 |
| 4,650,395 | 3/1987 | Weidner | 415/173.1 |
| 4,752,184 | 6/1988 | Liang | 415/173.3 |

FOREIGN PATENT DOCUMENTS

| | | | |
|---|---|---|---|
| 721453 | 1/1955 | United Kingdom | 415/134 |

*Primary Examiner*—John T. Kwon
*Attorney, Agent, or Firm*—Oliff & Berridge

[57] ABSTRACT

The shroud segments surrounding a stage of turbine blades are restrained against axial movement in one direction by a plurality of pins which protrude radially inwards from the turbine casing and locate behind dogs which are provided on a flange at preferably the upstream end of each segment. The use of pins in holes instead of internal profiled flanges or bolted flanges reduces weight, simplifies machining and reduces the number of parts required i.e. obviates nuts and bolts.

9 Claims, 2 Drawing Sheets

GAS TURBINE ENGINE BLADE SHROUD ASSEMBLY

The present invention relates to a shroud which when in situ in a gas turbine engine, surrounds a stage of rotatable blades.

More specifically, the invention relates to the retention of the shroud.

It is common practice to form blade shrouds from a number of shroud segments. The segments are assembled in side by side relationship with either or both of their upstream and downstream end supported on lands which are provided on adjacent guide vanes.

Internal flanges are formed on the outer casing which surrounds the shroud structure and dogs on the shroud ends locate behind dogs in the internal flanges so as to restrict movement of the shroud structure in directions axially of the associated gas turbine engine.

The present invention seeks to provide a blade shroud assembly in situ in a gas turbine engine and which includes improve retaining structure.

According to the present invention a blade shroud assembly comprises an annular array of shroud segments supported via their upstream and downstream ends on fixed structure and including radially outwardly turned flanges adjacent said ends, a turbine casing surrounding the shroud segments and a plurality of headed pins affixed in the turbine casing with their heads protruding radially inwardly therefrom and between the flanges and wherein a dog on a flange of each of at least some of the shroud segments so as to prevent bodily movement of each shroud segment at least in one common direction axially of the casing.

The invention will now be described, by way of example and with reference to the accompanying drawings in which.

Figure 2:
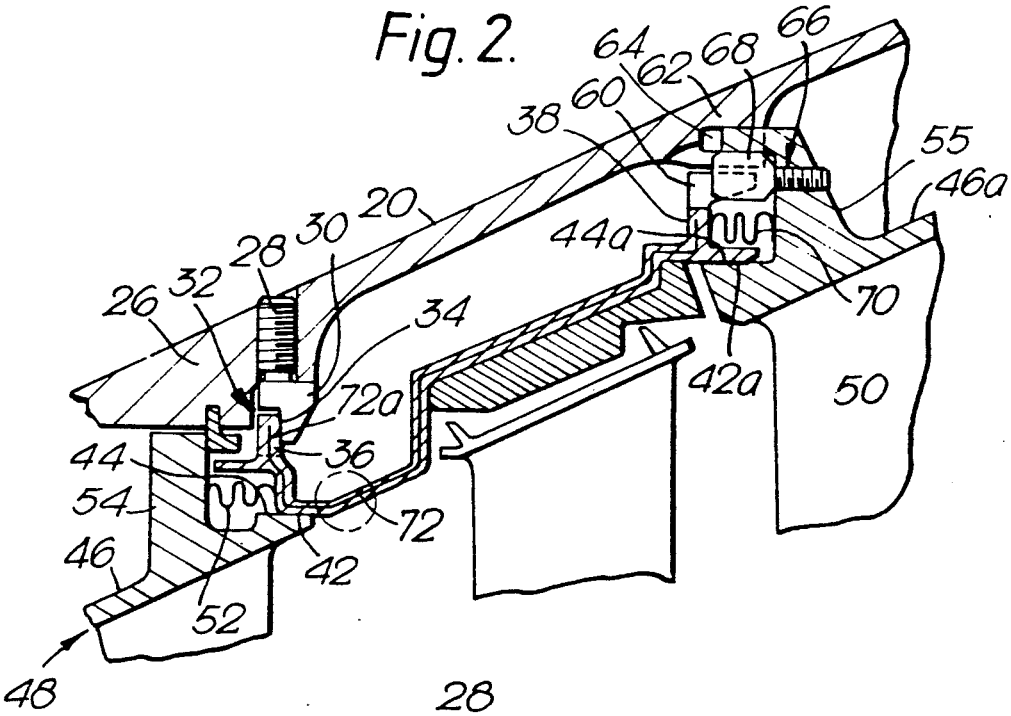
FIG. 2 is an enlarged, cross-sectional part view of FIG. 1.
Figure 2A:
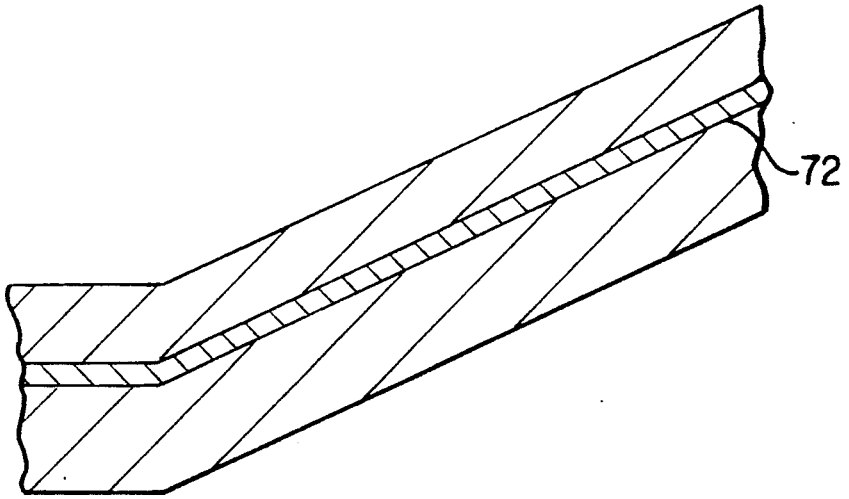

FIG. 2*a* is an enlarged, cross-sectional view of the detail encircled in FIG. 2.

Figure 3:
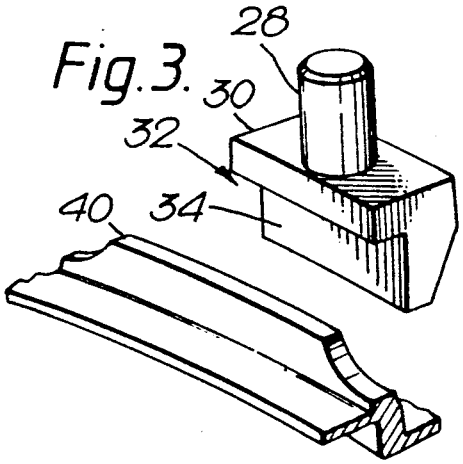

FIG. 3 is an exploded, pictorial part view of features of FIG. 2.

Figure 1:
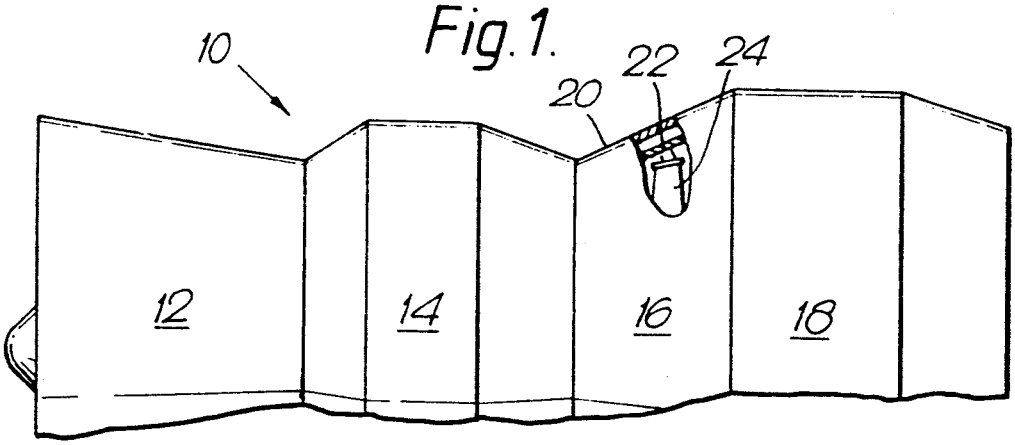
FIG. 1 is a diagrammatic view of a gas turbine engine incorporating an embodiment of the present invention.

Referring to FIG. 1. A gas turbine engine 10 includes a compressor 12, combustion equipment 14, a turbine section 16 and an exhaust duct 18, all in flow series in known manner.

The turbine section 16 includes a turbine casing 20 which surrounds an annular array of shroud segments 22. The shroud segments 22 in turn surround a stage of turbine blades 24.

Referring now to FIG. 2. The turbine casing 20 has a thickened portion 26 which has a number of holes drilled through it at positions around the casing and in a common plane, which is normal to the axis of the turbine casing. A pin 28 is force fitted into each hole.

Each pin 28 has a head 30 which when the pin is fitted, protrudes radially inwardly from the casing 20.

Each pin head 30 has a cut out 32 in an edge which faces upstream having regard to the flow of gases through the turbine stage 16 during operation of the engine 10. Thus a face 34 is provided which is flat in a plane radially of the axis of the casing 20.

Each shroud segment 22 is provided with radially outwardly turned flanges 36 and 38 at the upstream end and downstream end respectively.

In the present example, the upstream flange 36 of each segment 22 is relieved on its periphery to provide dogs 40, one of which is more clearly seen in FIG. 3.

On assembly of the shroud segments 22 into the turbine casing 20, lands 42 at the upstream ends of the shroud segments 22 are slid over cooperating lands 44 on the downstream edges of the shrouds 46 of fixed guide vanes 48. Similarity, lands 42*a* at the downstream ends of the shroud segments 22 slidingly located on cooperating lands 44*a* on the upstream edges of the shrouds 46*a* of fixed guide vanes 50.

The shroud segments 22 are slid forwardly towards the guide vanes 48 and in so doing trap an annular, hollow seal 52 between their flanges 36 and flanges 54 on the guide vanes 48. This in turn effectively traps the upstream ends of the shroud segments between the bellows seal 52 and the upstream faces 34 of the pin heads 30, thus restraining the shroud segments 22 against movement axially of the turbine casing 20 in a downstream direction.

The angular relationship between the dogs 40 on the flanges 36 and the pin heads 30 immediately before sliding the shroud segments 22 onto the lands 44, should be such that respective dogs 40 are between adjacent pin heads 30. Having been moved beyond the pin heads 30, the shroud segments 22 are then moved peripherally of the lands 44, so as to locate the dogs 40 behind respective pin heads 30. The axial load on the shroud segments 22 is then removed and the resilience in the bellows seal 52 will urge the flanges 36 against the faces 34 of the pin heads 30.

The outwardly turned flange 38 on the downstream end of one of the shroud members 22 has a slot 60 through its periphery. That portion 62 of the casing 20 which surrounds the flange 38 is thickened and the thickened portion has an internal slot 64 therethrough which is in radial alignment with the slot 60 when the shroud segments 22 are in their operating positions.

A pin 66 is force fitted into a hole in the flange 55 on the guide vane 50, the shroud 46*a* of which spans the slots 60 and 64. The pin 66 has a rectangular head 68 which projects into the slots 60 and 64 and thus restrains the shroud segments 22 against significant rotational movement about the axis of the casing 20. The dogs 40 at the upstream end of the shroud segments 22 are thus prevented from disengaging from the pin heads 30.

The flanges 38 and 55 also trap an annular bellows seal 70 between them.

In operation of the engine 10, when the hot gases pass over the turbine blades 24 they also heat the shroud segments 22 which expand in a direction axially of the casing 20. Since the shroud segments 22 are constrained at their upstream ends as described hereinbefore, they expand in a downstream direction. This is enabled by the sliding fit of the pin head 68 in the slots 60 and 64 and the resilience of the bellows seal 70.

It will be appreciated by the skilled man that the arrangement described herein provides reduced complexity of machining e.g. larger positional tolerances are acceptable, a reduction in the number of parts required i.e. one pin 28 is substituted for at least one each of nut, bolt and locking device. A consequent reduction in weight and a considerable easing of assembly, is thus achieved.

A further advantage is derived in that if hot gases leak between the two lands 42 and 44 into the interior of the bellows seal 52, the seal is pressurized. Since the shroud segment flange 36 is fixed, the pressurised seal is pressed against it and so enhances the seal effect and so hot gases are less likely to pass to the external surfaces of the shroud segments 22.

Whilst the invention has been described as having the radial pins at the upstream ends of the shroud segments, they could be positioned at the downstream ends thereof. However, since the gases which pass over the blades are hottest at the upstream end of the assembly, it is preferable to restrain the shroud segments at that end, so as to ensure that the most effective sealing is achieved there.

In order that the last shroud segment 22 can be fitted, it may prove necessary to obviate one pin 28, at that place where the last shroud segment 22 is to fit.

In an alternative embodiment, each pin 28 can be positioned so as to span adjacent flanges 40 of adjacent shroud members 22, where the flanges 40 are provided at the sides thereof (not shown).

Further pins 28 may be obviated if sealing strips 72 (as shown in FIGS. 2 and 2*a*) which bridge the gap between adjacent shroud segments 22, are extended into the flanges 40. The strips 72 will thus have radial portions 72*a* which can resist axial loads which will be exerted on them when shroud segments 22 which are not directly constrained by pins 28 attempt to move axially of the engine 10.

I claim:

1. A blade shroud assembly comprising an annular array of shroud segments supported via their upstream and downstream ends on fixed structure and including radially outwardly turned flanges adjacent said ends, a turbine casing surrounding the shroud segments and a plurality of headed pins affixed in the turbine casing with their heads protruding radially inwardly therefrom and between the flanges and wherein at least some of the flanges at common ends of the shroud segments are engaged by the heads of respective pins so as to prevent bodily movement of each shroud segment in one common direction axially of the casing; and further comprising another headed pin which is fixed in fixed structure at that end of a shroud segment remote from the radially aligned headed pins, the head of which further pin locates in radially aligned slots in the adjacent shroud segment flange and the adjacent portion of the engine casing when the heads of the radially aligned headed pins engage respective dogs, so as to prevent relative rotation between the shroud segments and fixed structure.

2. A blade shroud assembly as claimed in claim 1 wherein at least one of the shroud segments is indirectly restrained by said pins.

3. A blade shroud assembly as claimed in claim 1 wherein adjacent shroud segments have radially outwardly turned, adjacent flanges which are spanned by a respective common pin.

4. A blade shroud assembly as claimed in claim 2 wherein strip seals are included which span gaps between adjacent shroud edges and thereby resist axial movement of the at least one shroud segment indirectly restrained by pins.

5. A blade shroud assembly as claimed in claim 4 wherein the flanges are on the upstream ends of the shroud segments.

6. A blade shroud assembly as claimed in claim 4 wherein the fixed structure comprises stages of guide vanes, one stage being immediately upstream of the shroud segments, another stage being immediately downstream thereof.

7. A blade shroud assembly as claimed in claim 1 wherein the flanges are on the upstream ends of the shroud segments.

8. A blade shroud assembly as claimed in claim 7 wherein the fixed structure comprises stages of guide vanes, one stage being immediately upstream of the shroud segments, another stage begin immediately downstream thereof.

9. A blade shroud assembly as claimed in claim 1 wherein the fixed structure comprises steps of guide vanes, one stage being immediately upstream of the shroud segments, another stage being immediately downstream thereof.

* * * * *